US005988914A

United States Patent [19]

Kageyama et al.

[11] Patent Number: 5,988,914

[45] Date of Patent: Nov. 23, 1999

[54] WRITING INSTRUMENT

[75] Inventors: Hidehei Kageyama; Yoshihide Mitsuya, both of Kawagoe, Japan

[73] Assignee: Kotobuki & Co., Ltd., Kyoto, Japan

[21] Appl. No.: 09/152,077

[22] Filed: Sep. 11, 1998

[30] Foreign Application Priority Data

Sep. 12, 1997 [JP] Japan ..... 9-249085

[51] Int. Cl.[6] ..... B43K 25/00

[52] U.S. Cl. ..... 401/52; 401/68; 401/87; 401/49

[58] Field of Search ..... 401/52, 49, 55, 401/68, 69, 73, 75, 77, 78, 32, 65, 86, 87

[56] References Cited

U.S. PATENT DOCUMENTS 4,904,101 2/1990 Petterson ..... 401/52
5,662,425 9/1997 Mitsuya ..... 401/52
5,683,191 11/1997 Kageyama et al. .

FOREIGN PATENT DOCUMENTS 3-397 1/1991 Japan .

*Primary Examiner*—David J. Walczak
*Attorney, Agent, or Firm*—McGinn & Gibb, P.C.

[57] ABSTRACT

A writing instrument includes a tubular body, a guide sleeve, an outer sleeve, and a holder. The outer sleeve includes at least one groove on an inner surface thereof, and the guide sleeve includes at least one rib on a forward portion thereof to engage the groove of the outer sleeve. An inclined surface continuously inclining relative to the axial direction of the outer sleeve is formed at a rearward end portion of either side wall of the groove such that a width of the groove becomes wider in a direction of the rearward end. An inclined surface continuously inclining relative to the axial direction of the outer sleeve is formed at a forward end portion of either side wall of the rib such that a width of the rib becomes smaller in a direction of the forward end. An inclined angle of the inclined surface of the groove is not less than that of the inclined surface of the rib.

28 Claims, 8 Drawing Sheets

WRITING INSTRUMENT

BACKGROUND OF THE INVENTION

1. Field of the Invention

The present invention relates to a writing instrument, and more particularly to a writing instrument in which a stick-shaped object can be extended outwardly of the writing instrument by rotating a tubular body relative to an outer sleeve.

2. Description of the Related Art

A conventional writing instrument is disclosed in, for example, Japanese Utility Model Publication No. 3-397, which includes a cap having a guide sleeve rotatably assembled therein. The guide sleeve has axially extending slits formed therein and an eraser holder assembled thereto with outward projections of the holder fitting into the slits. Therefore, the eraser is movable in the axial direction of the guide sleeve.

A spiral-grooved sleeve is assembled around the outer circumference of the guide sleeve, and includes two half assemblies (e.g., two portions). The spiral-grooved sleeve is assembled integrally with the cap such that the spiral-grooved sleeve is not rotatable relative to the cap. The spiral-grooved sleeve is formed with a spiral groove which receives a tip of the outward projections of the eraser holder. The rearward end portion of a joint is fittingly mounted into the forward end portion of the guide sleeve, such that the joint and the guide sleeve are not rotatable relative to each other. The forward end portion of the joint is fitted into the rearward end of an outer sleeve which accommodates a writing member therein. The joint and the outer sleeve are assembled so that they are not rotatable relative to each other.

A rib-to-groove fitting engagement connects the guide sleeve to the joint such that they are not rotatable relative to each other. Likewise, a rib-to-groove fitting engagement connects the joint to the outer sleeve such that they are not rotatable relative to each other.

However, to fit the rib into the groove, the joint must be angularly accurately positioned about an axis thereof with respect to the guide sleeve and the outer sleeve. Fitting the guide sleeve into the joint, or fitting the joint into the outer sleeve requires a time-consuming assembly operation.

Another problem is that it is difficult to manufacture the rib and groove such that they are precisely configured to each other and such that the assembly does not rattle after the rib and groove have been assembled. Moreover, if the rib and groove are configured to each other with very small gaps therebetween, they are difficult to readily assemble. Consequently, a certain amount of rattling between the guide sleeve and the outer sleeve results.

SUMMARY OF THE INVENTION

The present invention was made in view of the aforementioned and other drawbacks of the conventional writing instruments.

An object of the present invention is to provide a writing instrument in which the guide sleeve and outer sleeve can be easily assembled such that the guide sleeve and the outer sleeve are not rotatable relative to each other.

Another object of the present invention is to provide a writing instrument in which the guide sleeve and outer sleeve are assembled so that assembly rattling is prevented.

A writing instrument according to a first aspect of the present invention includes a tubular body, a guide sleeve, an outer sleeve, and a holder. The tubular body has a spiral groove on an inner surface thereof. The guide sleeve has a rear portion fitted into the tubular body, so as to be rotatable relative to the tubular body, but not movable relative to the tubular body in the axial direction of the tubular body. The holder holds a stick-shaped object. The holder engages the guide sleeve, and is movable in the axial direction of the guide sleeve, but not rotatable relative to the guide sleeve. The holder has a projection slidably fitted into the spiral groove of the tubular body. The outer sleeve accommodates a writing element therein.

The outer sleeve has at least one groove on an inner surface thereof, while the guide sleeve has at least one rib on a forward portion thereof to engage the groove of the outer sleeve. An inclined surface, continuously inclining relative to the axial direction of the outer sleeve, is formed at a rearward end portion of either side wall of the groove such that a width of the groove becomes wider in a direction toward the rearward end. An inclined surface continuously inclining relative to the axial direction of the outer sleeve is formed at a forward end portion of either side wall of the rib such that a width of the rib becomes smaller in a direction toward the forward end. An inclined angle of the inclined surface of the rib is not less than that of the inclined surface of the groove.

When the forward portion of the guide sleeve is inserted into the inner surface of the rear portion of the outer sleeve, the inclined surface of the rib is guided along the inclined surface of the groove, so that both the sleeves can be properly angularly positioned about axes thereof with respect to each other. Due to the inclined angle of the inclined surface of the rib being not less than that of the inclined surface of the groove, a tip of the rib is prevented from sliding on the inclined surface of the groove. Instead, the inclined surface of the rib slides on the inclined surface of the groove. Thus, the guide sleeve can advance smoothly into the outer sleeve.

A writing instrument according to a second aspect of the present invention has a tubular body, a guide sleeve, an outer sleeve, and a holder. The tubular body has a spiral groove on an inner surface thereof. The guide sleeve has a rear portion fitted into the tubular body so as to be rotatable relative to the tubular body but not movable relative to the tubular body in the axial direction of the tubular body. The holder holds a stick-shaped object. The holder engages the guide sleeve, and is movable in the axial direction of the guide sleeve, but is not rotatable relative to the guide sleeve. The holder has a projection slidably fitted into the spiral groove of the tubular body. The outer sleeve accommodates a writing element therein.

The outer sleeve has at least one groove on an inner surface thereof, while the guide sleeve has at least one rib on a forward portion thereof to engage the groove of the outer sleeve. An inclined surface inclining relative to the axial direction of the outer sleeve is formed at a rearward end portion of either side wall of the groove such that a width of the groove becomes wider in a direction toward the rearward end portion. An inclined surface, inclining relative to the axial direction of the outer sleeve, is formed at a forward end portion of either side wall of the rib, such that a width of the rib becomes smaller as the forward end is approached. One of the inclined surface of the groove and the inclined surface of the rib includes a stepped surface, while the other of the inclined surface of the groove and the inclined surface of the rib includes a continuous surface. An inclined angle of the stepped surface is not larger than that of the continuous surface.

When either of the inclined surface of groove or the inclined surface of rib is formed to have a stepped-shaped, a similar operation to the first aspect of the present invention can be attained. When the forward portion of the guide sleeve is inserted into the inner surface of the rear portion of the outer sleeve, the inclined surface of the rib is guided along the inclined surface of the groove, so that both the sleeves can be properly angularly positioned about an axes thereof with respect to each other. Since the inclination of the envelope of the stepped surface is selected to be not larger than the inclination of the continuous surface, even if the tip of the continuous surface is stopped by one of the steps of the stepped surface, slightly rotating the guide sleeve about the axis allows the tip of the continuous surface easily to move out of mutual interference with the stepped surface. Thus, the guide sleeve can advance smoothly into the outer sleeve.

The forward portion of the guide sleeve may have a flange located forwardly of the rib and the rearward portion of the guide sleeve may have a larger diameter than the forward portion thereof. An outer surface of the flange contacts the inner surface of the outer sleeve, and an outer surface of a forward end of the rearward portion of the guide sleeve contacts the rear end portion of the inner surface of the outer sleeve.

Because the guide sleeve is supported by the outer sleeve at a plurality (e.g., two) of locations where the outer surface of the flange of the guide sleeve contacts the inner surface of the outer sleeve and where the outer surface of the forward end of the rearward portion of the guide sleeve contacts the rear end portion of the inner surface of the outer sleeve, the guide sleeve can be precisely assembled to the outer sleeve without rattling. Therefore, a gap between the rib and the groove can be allowed.

Preferably, the forward portion of the guide sleeve has openings formed on a side surface thereof and resilient projections formed on an inner surface where the openings are formed. The resilient projections elastically contact a rear end portion of the writing element.

The resilient projections easily receive the writing element by deforming the openings to allow smooth insertion of the writing element into the guide sleeve when the writing element is inserted into the guide sleeve. Additionally, the resilient projections elastically hold the writing element therebetween after the writing element has been fully inserted, to prevent an inadvertent pulling-out of the writing element.

The present disclosure relates to subject matter contained in Japanese Patent Application No. 9-249085, filed Sep. 12, 1997, which is expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS OF THE INVENTION

Figure 1:
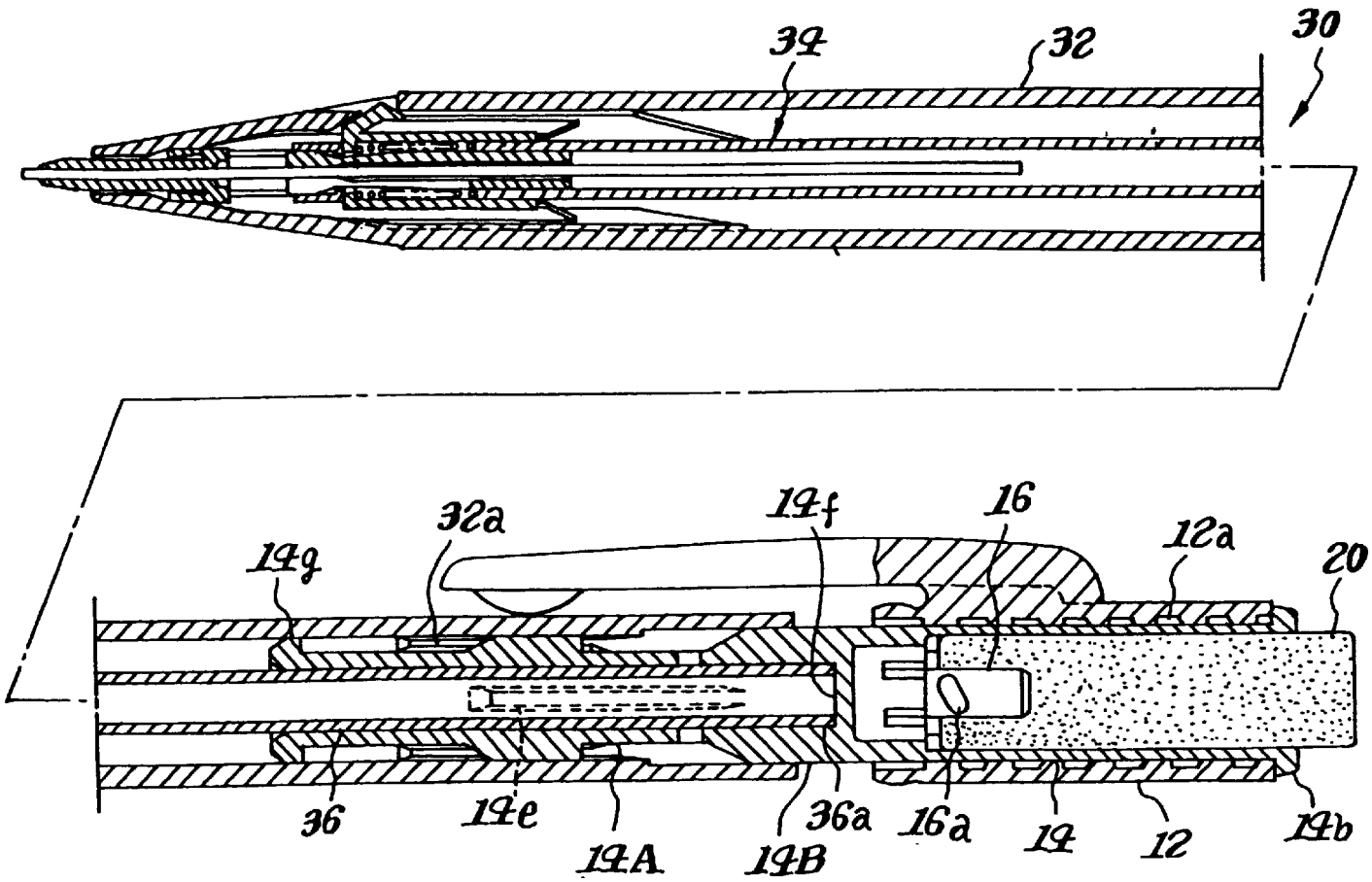
FIG. 1 is a longitudinal cross-sectional view illustrating a writing instrument according to a first embodiment of the present invention.
Figure 2:
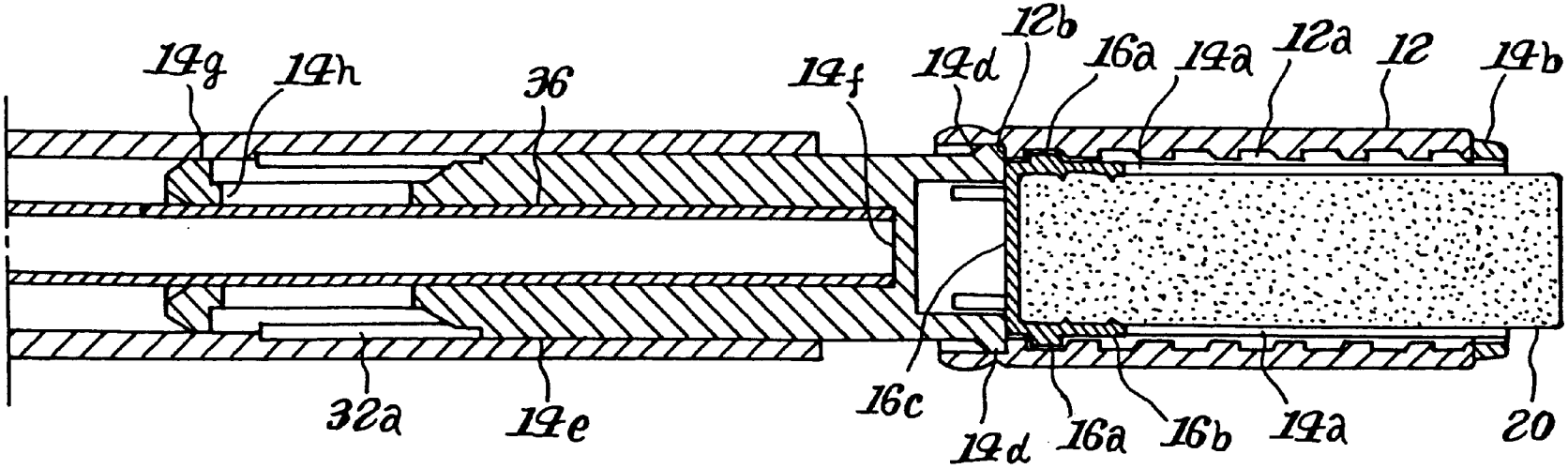
FIG. 2 is a longitudinal cross-sectional view of a rearward section of the writing instrument of FIG. 1 when the writing instrument is rotated 90 degrees from the position shown in FIG. 1.

A first embodiment of the invention will be described in detail with reference to FIGS. 1–7.

An exemplary writing instrument according to the present invention may be, for example, a mechanical pencil 30 including a stick-shaped object which can be advanced outwardly from a rear end of an outer sleeve 32 of the mechanical pencil 30. Obviously, the invention would work equally well with other types of writing instruments.

The mechanical pencil 30 includes a tubular body 12, a guide sleeve 14, a holder 16, and the outer sleeve 32. The tubular body 12 is formed with a spiral groove 12*a* in its inner surface. The guide sleeve 14 is inserted into the tubular body 12, such that the guide sleeve 14 is rotatable relative to the tubular body 12, but is not movable in an axial direction relative to the tubular body 12. The holder 16 holds the stick-shaped object 20, such as an eraser, marker, etc. The holder 16 has projections 16*a* that outwardly project to fit into the spiral groove 12*a*. The holder 16 is not rotatable relative to the guide sleeve 14. The outer sleeve 32 houses a writing element 34 therein.

Figure 3:
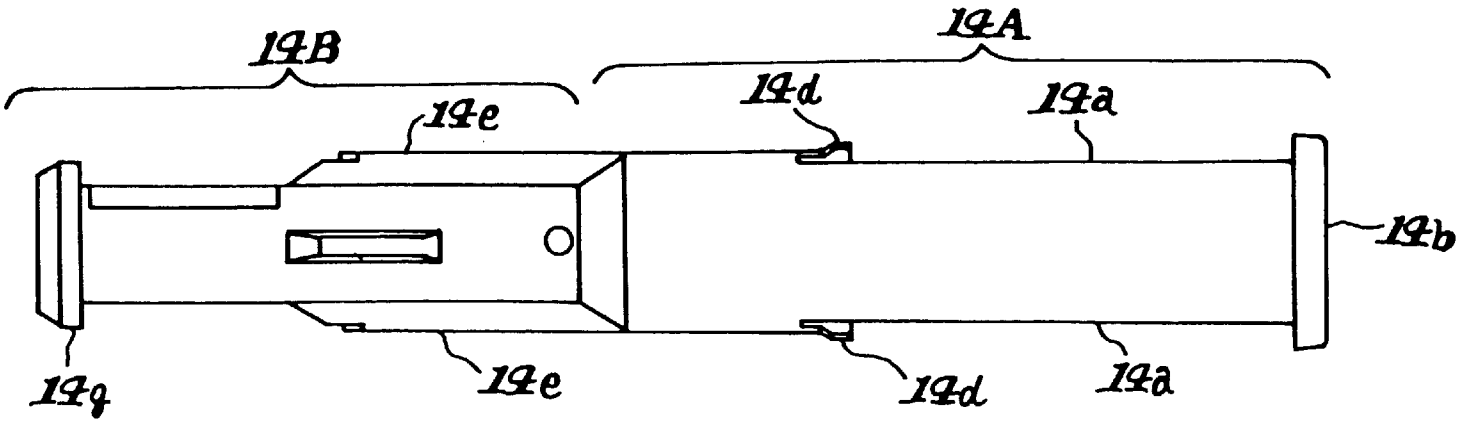
FIGS. 3(*a*) and 3(*b*) illustrate a guide sleeve 14 of the writing instrument of FIG. 1.
Figure 3:
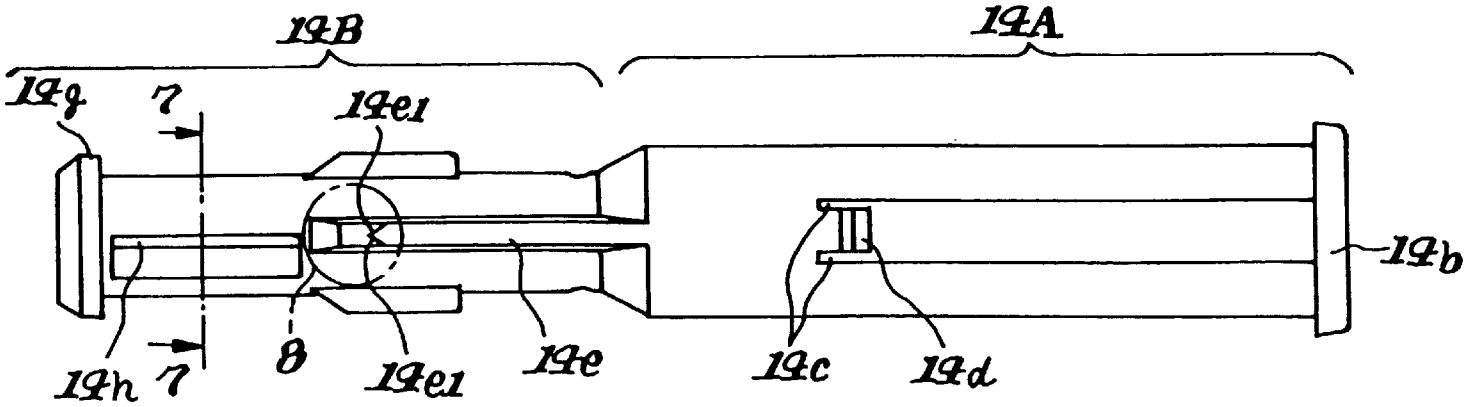
Figure 4:
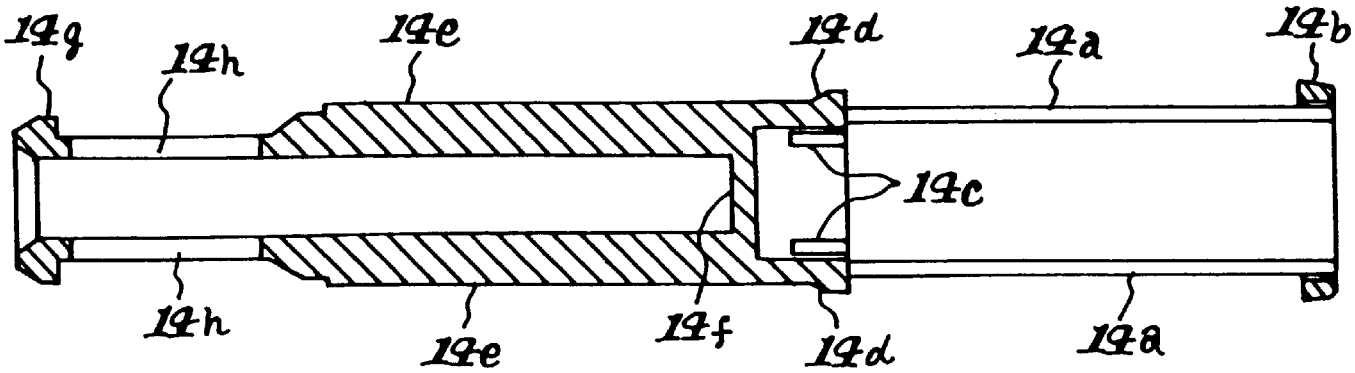
FIGS. 4(*a*) and 4(*b*) are longitudinal cross-sectional views of FIGS. 3(*a*) and 3(*b*), respectively.
Figure 4:
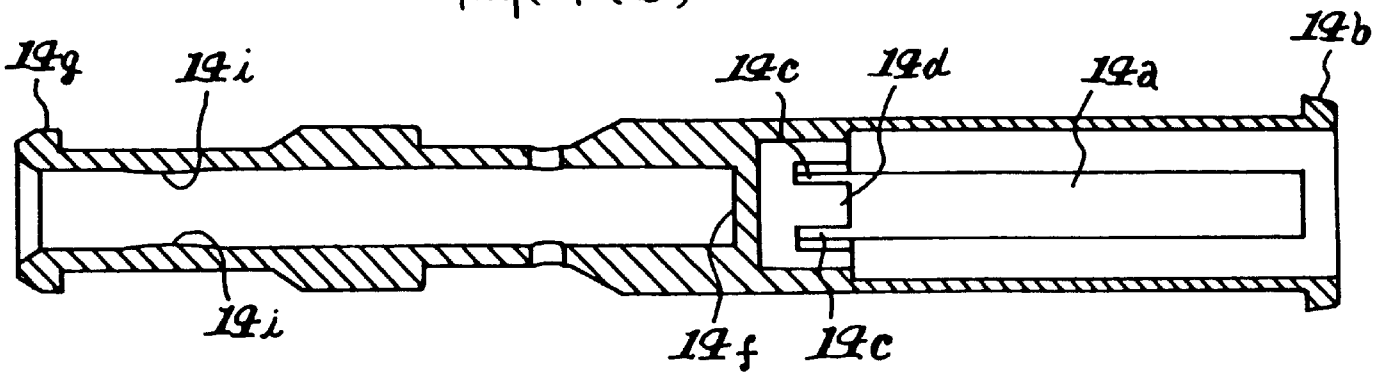

As shown in FIGS. 3(*a*)–3(*b*) and 4, the guide sleeve 14 is formed with two slits 14*a* in the rear portion 14A of the guide sleeve 14. The slits 14*a* extend in the axial direction of the guide sleeve 14. The guide sleeve 14 has a flange-shaped stopper 14*b* formed at its rearward end. Each slit 14*a* is connected with two narrow slits 14*c* formed in the forward end portion thereof. The two narrow slits 14*c* extend parallel to each other to define a projecting strip 14*d* therebetween which is resiliently flexible in a radial direction of the guide sleeve 14. The flange-shaped stopper 14*b* abuts the rear end of the tubular body 12, and the projecting strips 14*d* are received by an annular stepped portion 12*b* formed in the inner surface of the tubular body 12, so that the guide sleeve 14 is inserted into the tubular body 12 so as to be rotatable but not axially movable with respect to the tubular body 12.

The forward portion 14B of the guide sleeve 14 is inserted into a rear end portion of the outer sleeve 32 and accommodated therein, such that the guide sleeve 14 is not rotatable relative to the outer sleeve 32. As shown in FIGS. 3(*a*) and 3(*b*), the guide sleeve 14 has a plurality of ribs 14*e* (e.g., two ribs shown in the exemplary embodiment) formed on its outer surface of the forward portion 14B.

Figure 6:
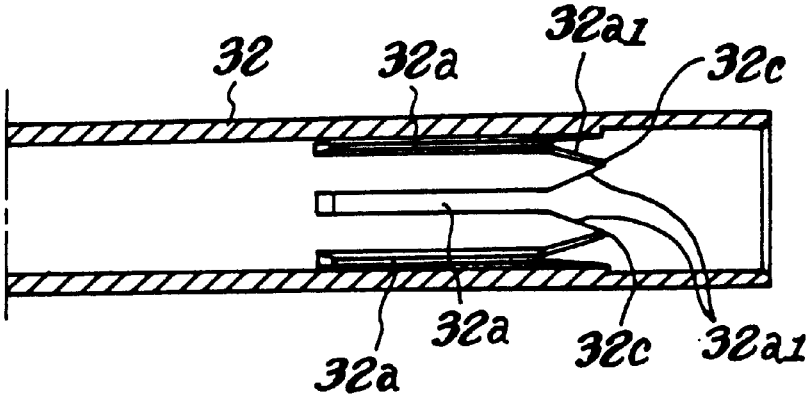
FIG. 6 is a longitudinal cross-sectional view of an outer sleeve 32 of the writing instrument of FIG. 1.

As shown in FIG. 6, the outer sleeve 32 is formed with a plurality of grooves 32*a* (e.g., six grooves in the exemplary embodiment) in its inner surface of the rearward portion. The grooves 32*a* extend in the axial direction of the outer sleeve 32. The ribs 14*e* fit into the grooves 32*a* when the forward portion 14B is inserted into the outer sleeve 32.

Inclined surfaces 14*e*1, continuously inclining relative to the axial direction of the outer sleeve 32 (e.g., the axial direction of the writing instrument), are formed at a forward end portion of side walls of the ribs 14*e*, such that a width of the ribs 14*e* becomes smaller in a direction toward the forward end. Likewise, inclined surfaces 32*a*1, continuously inclining relative to the axial direction of the outer sleeve 32 (e.g., the axial direction of the writing instrument), are formed at a rearward end portion of side walls of the grooves 32*a*, such that a width of the groove becomes wider in a direction toward the rearward end.

Figure 10A:
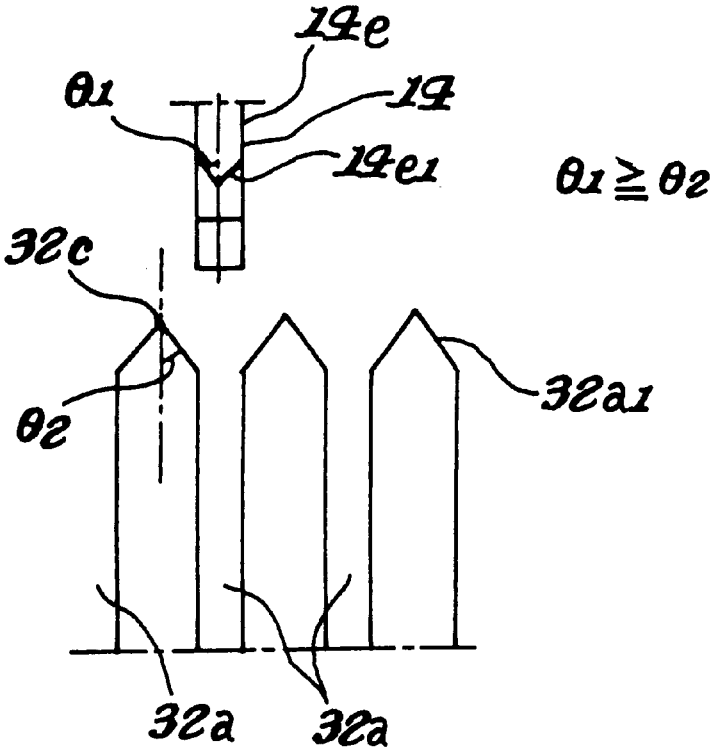
FIGS. 10(*a*) and 10(*b*) are developed views showing the relation between the inclined surfaces of the rib and grooves and the angles formed by the inclined surfaces.
Figure 10B:
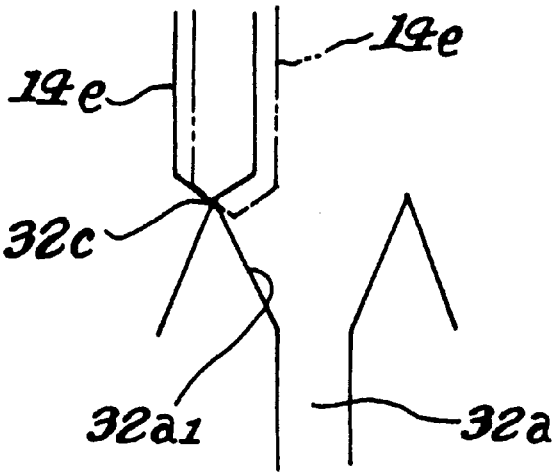

As shown in FIGS. 10(*a*) and 10(*b*), in this embodiment, an inclined angle θ1 of the inclined surface 14*e*1 of the ribs 14*e* from the axis of the writing instrument is approximately 30 degrees, while an inclined angle θ2 of the inclined surface 32*a*1 of the groove 32*a* from the axis of the writing instrument is approximately 27.5 degrees. The angles are selected such that $\theta 1 \geqq \theta 2$. It is noted that other angles other than the exemplary ones noted above can be employed so long as the relationship between θ1 and θ2 is maintained.

Therefore, when the guide sleeve 14 is inserted into the outer sleeve 32, the inclined surface 14*e*1 of the rib 14*e* is guided along the inclined surface 32*a*1 of the groove 32*a*, and the guide sleeve 14 is guided by the surfaces 32*a*1 and 14*e*1, so that the both sleeves 14, 32 can be properly angularly positioned about axes thereof with respect to each other.

As shown in FIG. 10(*b*), when the guide sleeve 14 is inserted into the outer sleeve 32, if the tip ends of the ribs 14*e* interfere with tips 32*c* of a ridge between grooves 32*a*, 32*a*, slightly rotating the guide sleeve 14 angularly about its axis will cause the tip ends of the ribs 14*e* to depart from the inclined surfaces 32*a*1 of the grooves 32*a* and the inclined surface 14*e*1 of the ribs 14*e* to slide along the inclined surfaces 32*a*1 of the grooves 32*a* (e.g., shown in dotted lines in FIG. 10(*b*)), thereby allowing smooth insertion of the guide sleeve 14 into the outer sleeve 32. For comparison, if the angle θ1 was smaller than θ2, then slightly rotating the guide sleeve 14 would allow the tip of the rib 14*e* to slide on the inclined surface 32*a*1. As a result, a relatively large mechanical resistance would be caused between the tip of the rib 14*e* and the inclined surface 32*a*1, which would prevent smooth insertion of the guide sleeve 14 into the outer sleeve 32.

The forward portion 14B of the guide sleeve 14 includes a flange 14*g* which is formed at the forward end and which extends radially outwardly. The diameter of the flange 14*g* is substantially the same as an inner diameter of the inner surface of the outer sleeve 32 measured where the ridges between the grooves 32*a* are formed. Thus, the diameter is substantially the same as a distance between the two ridges opposing each other. The flange 14*g* engagingly contacts the inner surface of the outer sleeve 32 at a forward position from the grooves 32*a*. The rear portion 14A has a larger diameter than the forward portion 14B. The diameter of an outer surface of the forward end of the rear portion 14A is substantially the same as an inner diameter of the inner surface of the outer sleeve 32 measured where the grooves 32*a* are formed. Thus, the diameter is substantially the same as a distance between the two grooves opposing each other.

Therefore, upon insertion of the forward portion 14B of the guide sleeve 14 into the inner surface of the outer sleeve 32, the flange 14*g* snugly contacts the inner surface of the outer sleeve 32, while the rear portion 14A snugly contacts the inner surface of the rear end portion of the outer sleeve 32. These two contact engagements allow assembly of the guide sleeve 14 into the outer sleeve 32 without rattling, while allowing the ribs 14*e* to engage the grooves 32*a* with some gaps therebetween. The front end of the flange 14*g* is preferably inwardly tapered to have smaller diameters toward the front end of the forward portion 14B (e.g., see FIGS. 3(*a*) and 3(*b*)), so that the guide sleeve 14 can be inserted easily into the outer sleeve 32.

Figure 7:
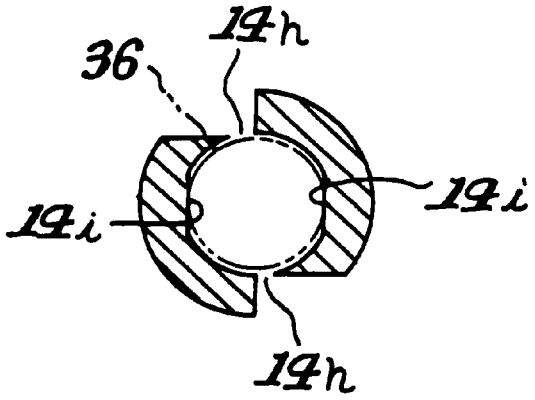
FIG. 7 is a cross-sectional view taken along lines 7—7 of FIG. 3(*b*)

The outer sleeve 32 accommodates a lead-advancing mechanism as a writing element 34 therein. A part of a lead-container 36 of a lead-advancing mechanism is fitted into the forward portion 14B of the guide sleeve 14. The guide sleeve 14 is formed with elongated openings 14*h* in the side surface of the forward portion 14B, thereby defining resilient projections 14*i*, as shown in FIG. 7. The resilient projections 14*i* diametrically oppose each other and extend inwardly toward each other from the circumferential inner surface of the guide sleeve 14. The resilient projections 14*i* deform radially outwardly, thereby allowing smooth insertion of the lead-container 36 into the guide sleeve 14 when the lead-container 36 is fitted into the guide sleeve 14, and holds the lead-container 36, via an urging force, to prevent the lead-container 36 from being pulled-out after the lead-container 36 has been fully inserted. The lead-container 36 is inserted into the guide sleeve 14 until a rear end 36*a* abuts a partition wall 14*f* formed in the guide sleeve 14. The shape of the openings 14*h* is such that split molds, that are split to right and left directions, respectively as shown in FIG. 7, can be used effectively to form the openings 14*h*.

Figure 5:
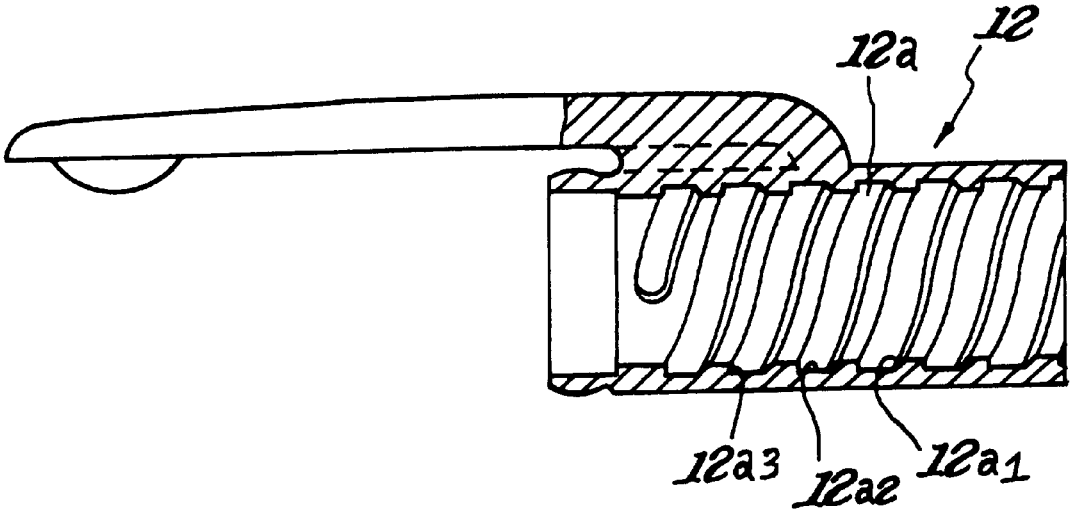
FIG. 5 is a longitudinal cross-sectional view of a tubular body 12 of FIG. 1.

As shown in FIG. 5, the spiral groove 12*a* formed in the tubular body 12 includes a flat bottom 12*a*2, a beveled wall 12*a*1, and a vertical wall 12*a*3 perpendicular to the fiat bottom 12*a*2. The beveled wall 12*a*1 tapers so that the depth of the groove becomes deeper toward the retracting direction of the stick-shaped object 20 (e.g., eraser, marker, or the like). The vertical wall 12*a*3 is positioned at the deepest side of the beveled wall 12*a*1. Beveled wall 12*a*1 allows a core pin having a male screw configured to the spiral grooves 12*a* to be pulled forcibly straight out of the tubular body 12 at the end of the molding process of the tubular body 12, without damaging the spiral groove 12*a*. Thus, the core pin need not be rotated relative to the tubular body along the spiral groove 12*a*, thereby allowing efficient manufacture of the tubular body 12.

The holder 16 includes holding pieces 16*b* which hold the stick-shaped object 20 therebetween and which are fitted into the slits 14*a*, and a bottom 16*c* that prevents the stick-shaped object 20 from moving backward into the guide sleeve 14. The holding piece 16*b* is formed with the projection 16*a* that projects outwardly of the holder 16 to fit into the spiral groove 12*a*.

With the writing instrument 30 having the above construction, the tubular body 12 is rotated relative to the outer sleeve 32, to advance the stick-shaped object 20. Rotating the tubular body 12 in a first direction causes a relative rotation between the tubular body 12 and holder 16 engaging slits 14*a* of the guide sleeve 14. The projection 16*a* fitted into the spiral groove 12*a* moves along the spiral groove 12*a*, so that the holder 16 is moved in the tubular body 12 in the axial direction while rotating, thereby allowing the stick-shaped object 20 to project outwardly from the rear end of the guide sleeve 12. Conversely, rotating the tubular body 12 in a second direction (e.g., opposite the first direction) causes the projection 16*a* to move backward along the spiral groove 12*a*, so that the stick-shaped object 20 retracts into the guide sleeve 12.

To outwardly advance the lead from the writing instrument, the guide sleeve 14 is forward-knocked (e.g., depressed) together with the tubular body 12 against the outer sleeve 32, so that the lead container 36 is pushed forwardly by the partition wall 14*f*. Thus, the lead is advanced by the known lead-advancing mechanism.

When refilling the lead-container with lead, the forward portion 14B of the guide sleeve 14 is disassembled from the rear end portion of the outer sleeve 32 and then new, unused leads are introduced into the lead-container 36. After the leads have been introduced into the lead-container 36, the ribs 14*e* are fitted into the grooves 32*a* so that the forward portion 14B of the guide sleeve 14 is angularly positioned about the axis of the outer sleeve 32 with respect to outer sleeve 32. Since the inclined angle of the inclined surfaces 14*e*1 of the rib 14 is not less (e.g., preferably larger) than that of the inclined surfaces 32*a*1, the forward portion 14B of the guide sleeve 14 can be smoothly inserted into the outer sleeve 32.

The inclined surfaces 14*e*1 of the ribs 14*e* and the inclined surfaces 32*a*1 of the grooves 32 are not limited to those continuously-shaped ones as shown in FIGS. 3(*a*)–3(*b*) and 6.

Figure 8:
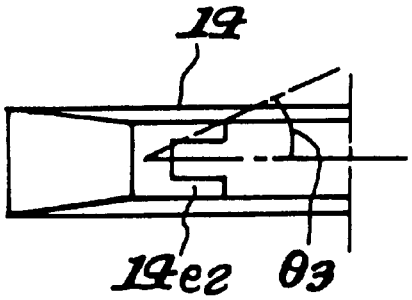
FIG. 8(*a*) is a partial expanded view of a rib and surrounding parts of the guide sleeve 14 in FIGS. 3(*a*)–3(*b*), and FIG. 8(*b*) is a side view of FIG. 8(*a*)
Figure 8:
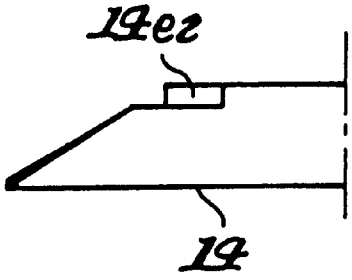
Figure 9:
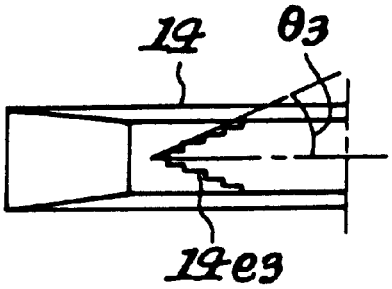
FIG. 9(*a*) is a partial expanded view of a rib and surrounding parts of the guide sleeve 14 of FIGS. 3(*a*)–3(*b*), and FIG. 9(*b*) is a side view of FIG. 9(*a*)
Figure 9:
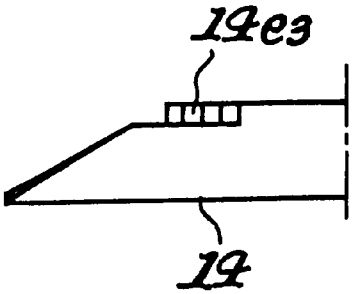

For example, the surfaces may have a stepped surface 14*e*2, as shown in FIGS. 8(*a*)–8(*b*), or may have a plurality of small steps 14*e*3, as shown in FIGS. 9(*a*)–9(*b*). An inclined angle θ3 of the envelope of the stepped surface shown in FIGS. 8(*a*)–8(*b*) and 9(*a*)–9(*b*) is preferably no larger than the inclined angle of the inclined surface 32*a*1. The angle θ3 is selected to be about 22.5 degrees in the present embodiment. It is noted that such an angle is merely exemplary and other values for the angle θ3 may be employed such that the angle is preferably no larger than the inclined angle of the inclined surface 32*a*1.

When the guide sleeve 14 is inserted into the outer sleeve 32, if the tip 32*c* of the groove 32 interferes with the stepped surface of the rib 14*e*, slightly rotating the guide sleeve 14 will free the stepped surface from interference, thereby allowing the guide sleeve 14 to advance into the outer sleeve 32.

Figure 11:
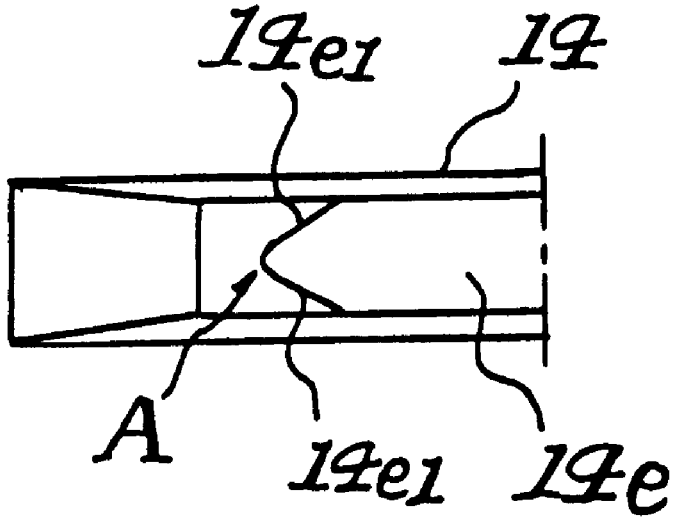
FIGS. 11(*a*) and 11(*b*) are partial expanded views of another embodiment of the rib of the guide sleeve 14 of FIGS. 3(*a*)–3(*b*).
Figure 11:
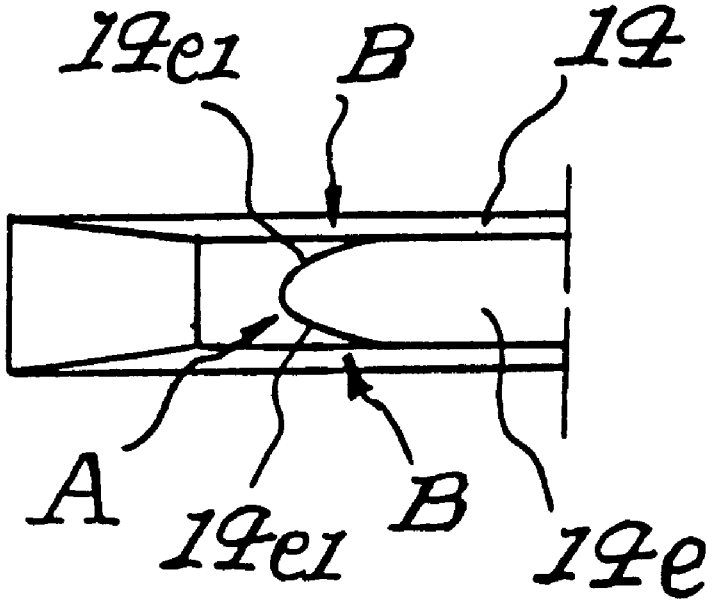

Though adjacent surfaces 14*e*1 (or adjacent surfaces 32*a*1) may make acute angles therebetween, the surfaces may be connected via a curved surface A, as shown in FIG. 11(*a*). Also, these inclined surfaces may be connected to the surfaces parallel to the axis of the guide sleeve 14 via a curved surface B as shown in FIG. 11(*b*). Eliminating abrupt changes in the surface prevents the ribs 14*e* from interfering with the grooves 32, thereby smoothly guiding the guide sleeve 14 into the outer sleeve 32.

While the invention has been described in terms of a preferred embodiment and modifications thereto, those skilled in the art will recognize that the invention can be practiced with modification within the spirit and scope of the appended claims.

What is claimed is:

1. A writing instrument, comprising:

a tubular body having a spiral groove on an inner surface thereof;

a guide sleeve having a rearward portion being fitted into the tubular body so as to be rotatable but immovable in an axial direction relative to the tubular body;

a holder for holding a stick-shaped object, the holder engaging the guide sleeve so as to be movable in an axial direction but not rotatable relative to the guide sleeve, said holder having a projection slidably fitted into the spiral groove of the tubular body; and an outer sleeve for accommodating a writing element therein, wherein the outer sleeve includes at least one groove on an inner surface thereof, and the guide sleeve includes at least one rib on a forward portion thereof to engage the groove of the outer sleeve, wherein an inclined surface, continuously inclining relative to the axial direction of the outer sleeve, is formed at a rearward end portion of either side wall of the groove, such that a width of the groove becomes wider in a direction toward the rearward end portion, wherein an inclined surface, continuously inclining relative to the axial direction of the outer sleeve, is formed at a forward end portion of either side wall of the rib, such that a width of the rib becomes smaller in a direction toward the forward end portion, and wherein an inclined angle of the inclined surface of the rib is not less than that of the inclined surface of the groove.

2. The writing instrument according to claim 1, wherein the forward portion includes an outwardly extending flange between the rib and a forward end of the guide sleeve, and the rearward portion has a larger diameter than the forward portion, an outer surface of the flange being in contact with the inner surface of the outer sleeve and the rearward portion of the guide sleeve being in contact with a rear portion of the inner surface of the outer sleeve.

3. The writing instrument according to claim 1, wherein the forward portion is formed with openings on a side surface thereof to define resilient projections on the inner surface of said guide sleeve substantially adjacent where the openings are formed, said resilient projections adapted to elastically contact a rear end portion of the writing element.

4. A writing instrument, comprising:

a tubular body having a spiral groove on an inner surface thereof;

a guide sleeve having a rearward portion being fitted into the tubular body so as to be rotatable but immovable in an axial direction relative to the tubular body;

a holder for holding a stick-shaped object, the holder engaging the guide sleeve so as to be movable in an axial direction but not rotatable relative to the guide sleeve, said holder having a projection slidably fitted into the spiral groove of the tubular body; and an outer sleeve for accommodating a writing element therein, wherein the outer sleeve includes at least one groove on an inner surface thereof, and the guide sleeve includes at least one rib on a forward portion thereof to engage the groove of the outer sleeve, wherein an inclined surface, inclining relative to the axial direction of the outer sleeve, is formed at a rearward end portion of either side wall of the groove, such that a width of the groove becomes wider in a direction toward the rearward end portion, and wherein an inclined surface, inclining relative to the axial direction of the outer sleeve, is formed at a forward end portion of either side wall of the rib, such that a width of the rib becomes smaller in a direction toward the forward end portion, one of the inclined surface of the groove and the inclined surface of the rib comprising a stepped surface while the other of the inclined surface of the groove and the inclined surface of the rib comprises a continuous surface, an inclined angle of the stepped surface being no larger than that of the continuous surface.

5. The writing instrument according to claim 4, wherein the forward portion includes an outwardly extending flange between the rib and a forward end of the guide sleeve, and the rearward portion has a larger diameter than the forward portion, an outer surface of the flange being in contact with the inner surface of the outer sleeve and the rearward portion of the guide sleeve being in contact with a rear portion of the inner surface of the outer sleeve.

6. The writing instrument according to claim 4, wherein the forward portion is formed with openings on a side surface thereof to define resilient projections on the inner surface of said guide sleeve substantially adjacent where the openings are formed, said resilient projections adapted to elastically contact a rear end portion of the writing element.

7. A writing instrument, comprising:

a tubular body having a groove on an inner surface thereof;

a guide sleeve having a rearward portion being fitted into the tubular body so as to be rotatable but immovable in an axial direction relative to the tubular body;

a holder for holding a stick-shaped object, the holder engaging the guide sleeve so as to be movable in an axial direction but not rotatable relative to the guide sleeve; and an outer sleeve for accommodating a writing element therein, wherein the outer sleeve includes at least one groove on an inner surface thereof, and the guide sleeve includes at least one rib on a forward portion thereof to engage the groove of the outer sleeve, wherein an inclined surface, continuously inclining relative to the axial direction of the outer sleeve, is formed at a rearward end portion of either side wall of the groove of the outer sleeve, such that a width of the groove of the outer sleeve becomes wider in a direction toward the rearward end portion.

8. A writing instrument, comprising:

a tubular body having a groove on an inner surface thereof;

a guide sleeve having a rearward portion being fitted into the tubular body so as to be rotatable but immovable in an axial direction relative to the tubular body;

a holder for holding a stick-shaped object, the holder engaging the guide sleeve so as to be movable in an axial direction but not rotatable relative to the guide sleeve; and an outer sleeve for accommodating a writing element therein, wherein the outer sleeve includes at least one groove on an inner surface thereof, and the guide sleeve includes at least one rib on a forward portion thereof to engage the groove of the outer sleeve, wherein an inclined surface, continuously inclining relative to the axial direction of the outer sleeve, is formed at a forward end portion of either side wall of the rib, such that a width of the rib becomes smaller in a direction toward the forward end portion.

9. The writing instrument according to claim 8, wherein an inclined surface, continuously inclining relative to the axial direction of the outer sleeve, is formed at a rearward end portion of either side wall of the groove of the outer sleeve, such that a width of the groove of the outer sleeve becomes wider in a direction toward the rearward end portion, and an inclined angle of the inclined surface of the rib is not less than that of the inclined surface of the groove of the outer sleeve.

10. The writing instrument according to claim 9, wherein, when the guide sleeve is inserted into the outer sleeve, the inclined surface of the rib is guided along the inclined surface of the groove, and the guide sleeve is guided by the surfaces, so that said guide sleeve and said outer sleeve are angularly positioned about axes thereof with respect to each other.

11. The writing instrument according to claim 8, wherein the forward portion includes an outwardly extending flange between the rib and a forward end of the guide sleeve, and the rearward portion has a larger diameter than the forward portion.

12. The writing instrument according to claim 11, wherein an outer surface of the flange is in contact with the inner surface of the outer sleeve and the rearward portion of the guide sleeve is in contact with a rear portion of the inner surface of the outer sleeve.

13. The writing instrument according to claim 8, wherein the forward portion is formed with openings on a side surface thereof to define resilient projections on the inner surface of said guide sleeve substantially adjacent where the openings are formed.

14. The writing instrument according to claim 13, wherein said resilient projections are adapted to elastically contact a rear end portion of the writing element.

15. The writing instrument according to claim 8, wherein said guide sleeve is formed with two slits in the rear portion of the guide sleeve, and said guide sleeve has a flange-shaped stopper formed at its rearward end, each of said slits being connected with two relatively narrower slits formed in the forward end portion thereof, said two narrower slits extending parallel to each other to define a projecting strip therebetween which is resiliently flexible in a radial direction of the guide sleeve, wherein the flange-shaped stopper abuts a rear end of the tubular body, and the projecting strips are received by an annular stepped portion formed in the inner surface of the tubular body, so that the guide sleeve is inserted into the tubular body so as to be rotatable but not axially movable with respect to the tubular body.

16. The writing instrument according to claim 15, wherein said groove of said tubular body includes a spiral groove, said spiral groove including a flat bottom, a beveled wall, and a substantially vertical wall perpendicular to the flat bottom, said beveled wall being tapered so that a depth of the spiral groove becomes deeper toward a retracting direction of a stick-shaped object held in said holder, and said vertical wall being positioned at a deepest side of the beveled wall, wherein said holder includes holding pieces which hold the stick-shaped object therebetween and which are fitted into the slits of said guide sleeve, and a bottom that prevents the stick-shaped object from moving backward into the guide sleeve, said holding piece is formed with a projection that projects outwardly of the holder to fit into the spiral groove, wherein the tubular body is rotated relative to the outer sleeve, to advance the stick-shaped object, wherein rotating the tubular body in a first direction causes a relative rotation between the tubular body and holder engaging slits of the guide sleeve, and the projection fitted into the spiral groove moves along the spiral groove, such that the holder is moved in the tubular body in the axial direction while rotating.

17. The writing instrument according to claim 8, wherein the forward portion of the guide sleeve includes a flange which is formed at the forward end and which extends radially outwardly, and wherein the diameter of the flange is substantially the same as an inner diameter of the inner surface of the outer sleeve, said flange engagingly contacting the inner surface of the outer sleeve at a forward position from the groove of the outer sleeve, the rear portion of the guide sleeve having a larger diameter than the forward portion, the diameter of an outer surface of a forward end of the rear portion being substantially the same as an inner diameter of the inner surface of the outer sleeve measured where the groove of the outer sleeve is formed, wherein upon insertion of the forward portion of the guide sleeve into the inner surface of the outer sleeve, the flange snugly contacts the inner surface of the outer sleeve, while the rear portion snugly contacts the inner surface of a rear end portion of the outer sleeve, and wherein said guide sleeve is formed with elongated openings in a side surface of the forward portion, thereby defining resilient projections opposing each other and extending inwardly toward each other from the circumferential inner surface of the guide sleeve, said resilient projections deforming radially outwardly.

18. The writing instrument according to claim 8, wherein an inclined surface, continuously inclining relative to the axial direction of the outer sleeve, is formed at a rearward end portion of either side wall of the groove, such that a width of the groove becomes wider in a direction toward the rearward end portion, one of said inclined surface of the rib and the inclined surface of the groove is a stepped surface that includes at least one step and an inclined angle of the inclined surface being the stepped surface is no larger than that of the inclined surface not being the stepped surface.

19. The writing instrument according to claim 7, wherein an inclined surface, continuously inclining relative to the axial direction of the outer sleeve, is formed at a forward end portion of either side wall of the rib, such that a width of the rib becomes smaller in a direction toward the forward end portion, and an inclined angle of the inclined surface of the rib is not less than that of the inclined surface of the groove of the outer sleeve.

20. The writing instrument according to claim 19, wherein, when the guide sleeve is inserted into the outer sleeve, the inclined surface of the rib is guided along the inclined surface of the groove, and the guide sleeve is guided by the surfaces, so that said guide sleeve and said outer sleeve are angularly positioned about axes thereof with respect to each other.

21. The writing instrument according to claim 7, wherein the forward portion includes an outwardly extending flange between the rib and a forward end of the guide sleeve, and the rearward portion has a larger diameter than the forward portion.

22. The writing instrument according to claim 21, wherein an outer surface of the flange is in contact with the inner surface of the outer sleeve and the rearward portion of the guide sleeve is in contact with a rear portion of the inner surface of the outer sleeve.

23. The writing instrument according to claim 7, wherein the forward portion is formed with openings on a side surface thereof to define resilient projections on the inner surface of said guide sleeve substantially adjacent where the openings are formed.

24. The writing instrument according to claim 23, wherein said resilient projections are adapted to elastically contact a rear end portion of the writing element.

25. The writing instrument according to claim 7, wherein said guide sleeve is formed with two slits in the rear portion of the guide sleeve, and said guide sleeve has a flange-shaped stopper formed at its rearward end, each said slit being connected with two relatively narrower slits formed in the forward end portion thereof, said two narrower slits extending parallel to each other to define a projecting strip therebetween which is resiliently flexible in a radial direction of the guide sleeve, the flange-shaped stopper abuts a rear end of the tubular body, and the projecting strips are received by an annular stepped portion formed in the inner surface of the tubular body, so that the guide sleeve is inserted into the tubular body so as to be rotatable but not axially movable with respect to the tubular body.

26. The writing instrument according to claim 25, wherein said groove of said tubular body includes a spiral groove, said spiral groove including a flat bottom, a beveled wall, and a substantially vertical wall perpendicular to the flat bottom, said beveled wall being tapered so that a depth of the groove becomes deeper toward a retracting direction of a stick-shaped object held in said holder, and said vertical wall being positioned at a deepest side of the beveled wall, wherein said holder includes holding pieces which hold the stick-shaped object therebetween and which are fitted into the slits of said guide sleeve, and a bottom that prevents the stick-shaped object from moving backward into the guide sleeve, said holding piece is formed with a projection that projects outwardly of the holder to fit into the spiral groove, wherein the tubular body is rotated relative to the outer sleeve, to advance the stick-shaped object, wherein rotating the tubular body in a first direction causes a relative rotation between the tubular body and holder engaging slits of the guide sleeve, and the projection fitted into the spiral groove moves along the spiral groove, such that the holder is moved in the tubular body in the axial direction while rotating.

27. The writing instrument according to claim 7, wherein the forward portion of the guide sleeve includes a flange which is formed at a forward end and which extends radially outwardly, and wherein the diameter of the flange is substantially the same as an inner diameter of the inner surface of the outer sleeve, said flange engagingly contacting the inner surface of the outer sleeve at a forward position from the groove of the outer sleeve, the rear portion of the guide sleeve has a larger diameter than the forward portion, the diameter of an outer surface of a forward end of the rear portion being substantially the same as an inner diameter of the inner surface of the outer sleeve measured where the groove of the outer sleeve is formed, wherein upon insertion of the forward portion of the guide sleeve into the inner surface of the outer sleeve, the flange snugly contacts the inner surface of the outer sleeve, while the rear portion snugly contacts the inner surface of a rear end portion of the outer sleeve, wherein said guide sleeve is formed with elongated openings in a side surface of the forward portion, thereby defining resilient projections opposing each other and extending inwardly toward each other from the circumferential inner surface of the guide sleeve, said resilient projections deforming radially outwardly.

28. The writing instrument according to claim 7, wherein an inclined surface, continuously inclining relative to the axial direction of the outer sleeve, is formed at a forward end portion of either side wall of the rib, such that a width of the rib becomes smaller in a direction toward the forward end portion, one of said inclined surface of the rib and the inclined surface of the groove is a stepped surface that includes at least one step and an inclined angle of the inclined surface being the stepped surface is no larger than that of the inclined surface not being the stepped surface.

* * * * *